US012041995B1

(12) United States Patent
Lee et al.

(10) Patent No.: US 12,041,995 B1
(45) Date of Patent: Jul. 23, 2024

(54) WIG CAPABLE OF FORMING NATURAL BENT HAIR AND METHOD FOR MANUFACTURING SAME

(71) Applicant: Ji Soo Lee, Seoul (KR)

(72) Inventors: Ji Soo Lee, Seoul (KR); Hyun Joo Shim, Seoul (KR)

(73) Assignee: Ji Soo Lee, Seoul (KR)

( * ) Notice: Subject to any disclaimer, the term of this patent is extended or adjusted under 35 U.S.C. 154(b) by 0 days.

(21) Appl. No.: 18/477,065

(22) Filed: Sep. 28, 2023

(30) Foreign Application Priority Data

Sep. 18, 2023 (KR) ..... 10-2023-0124204

(51) Int. Cl.
*A41G 3/00* (2006.01)

(52) U.S. Cl.
CPC ..... *A41G 3/0066* (2013.01); *A41G 3/005* (2013.01); *A41G 3/0075* (2013.01)

(58) Field of Classification Search
None
See application file for complete search history.

(56) References Cited

U.S. PATENT DOCUMENTS 3,589,376 A * 6/1971 Kohler ..... A41G 3/0075 132/201
3,794,933 A * 2/1974 Moorhead ..... A41G 3/0066 132/201
5,044,382 A * 9/1991 Ando ..... A41G 3/005 132/54
9,516,908 B2 * 12/2016 Miyatake ..... A41G 3/0041
2008/0041405 A1 * 2/2008 Kitsu ..... A41G 3/0075 132/201
2017/0112212 A1 * 4/2017 Tao ..... A41G 3/0066
2019/0059486 A1 * 2/2019 Kim ..... A41G 3/005

FOREIGN PATENT DOCUMENTS

KR 10-2003-0051940 A 6/2003
KR 10-2064598 B1 1/2020
KR 10-2136818 B1 7/2020

OTHER PUBLICATIONS

Wigs.com The Pros and Cons of Permatease https://www.wigs.com/blogs/news/the-pros-and-cons-of-permatease#:~:text=June%2016%2C%202022,the%20base%20of%20the%20cap., Jun. 16, 2022 (Year: 2022).*

* cited by examiner

*Primary Examiner* — Tatiana L Nobrega
(74) *Attorney, Agent, or Firm* — NKL LAW; Jae Youn Kim

(57) ABSTRACT

The present technology relates to a wig capable of naturally implementing a bent hair without using an additional beauty tool by knotting an irregular pattern of long and short hairs in a hair net, and more specifically, to a wig styled by knotting natural or artificial hairs on a hair net formed in a head shape, which includes a hair portion where a plurality of long hairs are knotted to hang down toward a non-crown area of a hair net, and a bent hair forming portion where short hairs and long hairs are knotted to have an irregular pattern, respectively, in a crown area of the hair net excluding the non-crown area.

2 Claims, 8 Drawing Sheets

WIG CAPABLE OF FORMING NATURAL BENT HAIR AND METHOD FOR MANUFACTURING SAME

BACKGROUND OF THE INVENTION

Field of the Invention

The present technology relates to a wig capable of naturally implementing a bent hair without using an additional beauty tool by knotting an irregular pattern of long and short hairs in a hair net.

Description of the Prior Art

In general, wigs are worn by people who do not have a lot of hairs or have a bald head due to a partial or total hair loss in order to hide the same, but recently wigs have been used as a fashion tool to express people's own unique and different individuality.

The wigs are made in the form of a mesh net, and may be classified into a handmade wig and a sewing wig according to whether the wig is made by knotting wig yarns manually or by a sewing machine in a cap having a head shape using mannequin, etc., and the wig may be divided into a whole wig for covering an entire head and a partial wig for covering only a portion having thin hair according to a use thereof.

The wigs are usually composed of wig yarns such as artificial hair, human hair, or the like and a cap at which hairs are knotted and which is detachably fixed to a head.

In particular, as shown in FIG. 1, there is provided a whole wig 10 in which a user may selectively change a hairstyle through a basic shape where the wig yarns of long hair hang down in one direction, that is, downwardly so as to be symmetrical to each other based on a parting line P/L.

In other words, when a user desires to form a volume in the front of a head, a conventional whole wig has a problem in that a direction of knotted wig yarns is made in one way, and whether or not the wig is worn is easily recognized due to unnaturalness in which a natural volume is not implemented due to a weight of the corresponding wig yarns, and sustainability of the formed bent hair is deteriorated.

RELATED ART REFERENCES

Patent Documents

Korean Registered Patent No. 10-2064598 (publicized on Jan. 9, 2020)

Korean Registered Patent No. 10-2136818 (publicized on Jul. 23, 2020)

Korean Unexamined Patent No. 10-2003-0051940 (publicized on Jun. 26, 2003)

SUMMARY OF THE INVENTION

In order to solve the conventional problems described above, an object of the present invention is to provide a wig in which a knotting pattern of wig yarns is changed to form a natural bent hair using the wig yarns so that whether or not the wig is worn may not be easily recognized and sustainability of the formed bent hair may be improved.

In order to solve the problems in the related art as described above, a wig capable of forming a natural bent hair according to the present invention may be a wig styled by knotting natural or artificial hairs on a hair net 100 formed in a head shape, in which the wig may include a hair portion 100 where a plurality of long hairs are knotted to hang down toward a non-crown area 310 of a hair net 300; and a bent hair forming portion 200 where short hairs and long hairs are knotted to have an irregular pattern, respectively, in a crown area 320 of the hair net 300 excluding the non-crown area 310.

In addition, it may be preferable that the short hairs knotted in the crown area 320 support the long hairs knotted to hang down toward the non-crown area 310 to form a volume in the bent hair forming portion 200.

Furthermore, it may be preferable that a height of the short hairs knotted in the crown area 320 gradually decreases in a direction from a parting line P/L to the non-crown area 310.

Moreover, it may be preferable that a height of the short hairs knotted in the crown area 320 gradually increases in a direction from a parting line P/L to the non-crown area 310.

Besides, it may be preferable that an inclination of the short hairs knotted in the crown area 320 gradually decreases in a direction from a parting line P/L to the non-crown area 310.

According to the present invention, differently from the related art, short hairs are knotted in an irregular pattern in a crown area excluding a non-crown area formed by knotting a plurality of first long hairs, and then a plurality of second long hairs are knotted in the crown area where the short hairs do not exist, so that the second long hairs can be supported at an upper end of the short hairs, thus having an effect of implementing a natural bent hair based on a front head portion and a parting line even through a user's brushing, etc.

DETAILED DESCRIPTION OF THE INVENTION

Figure 1:
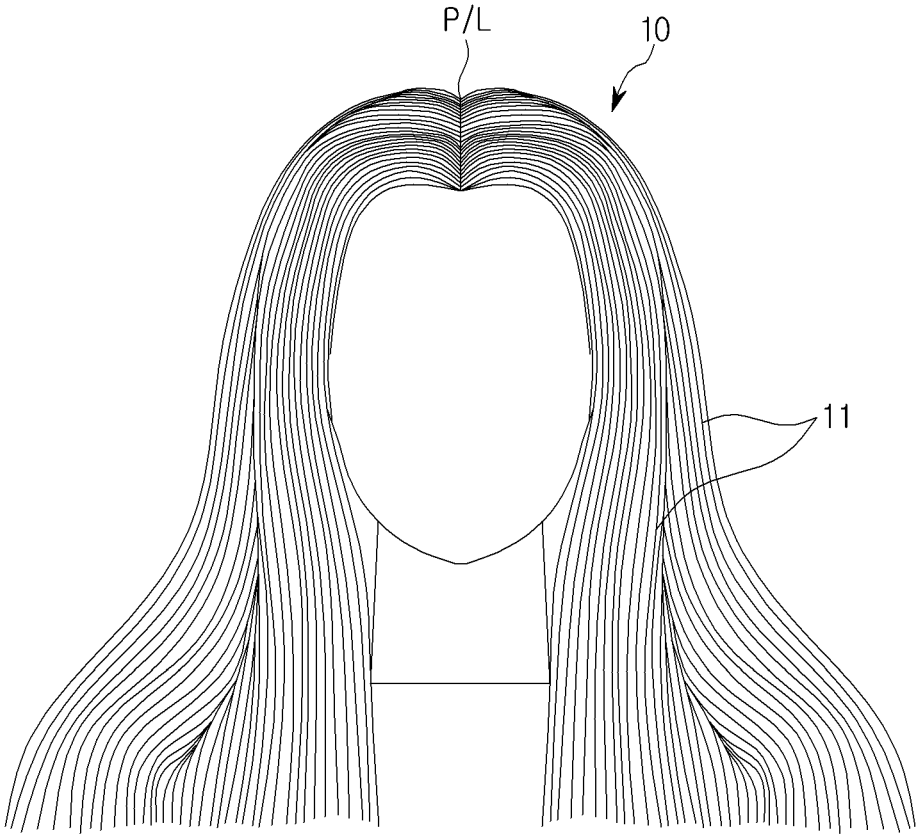
FIG. 1 is a view showing a conventional wig formed by knotting a plurality of long hairs.

Hereinafter, the present invention will be described in more detail with reference to the accompanying drawings. The embodiments described in the present specification may be variously modified. Specific embodiments are depicted in the drawings and may be described in detail in the detailed description. However, the specific embodiments disclosed in the accompanying drawings are only for easy understanding of various embodiments. However, the technical idea is not limited by the specific embodiments disclosed in the accompanying drawings, and it should be understood that the present invention includes all equivalents and replacements included in the spirit and technical scope of the present invention.

Terms including ordinal numbers such as first, second, etc., may be used to describe various components, but the components are not limited by the above terms. The terms described above may be used only for distinguishing one component from other components.

In the present specification, the terms "including," "having" or the like are used to designate that the features, numbers, steps, operations, elements, components or combinations thereof described in the specification are present, and are not to be understood as excluding the possibility that one or more other features, numbers, steps, operations, elements, components, or combinations thereof may be present or added. When one element is described as being "connected" or "accessed" to another element, it shall be construed as being connected or accessed to the other element directly but also as possibly having another element in between. On the other hand, if one element is described as being "directly connected" or "directly accessed" to another element, it shall be construed that there is no other element in between.

Besides, in the description of the present invention, a detailed description of related known functions or configurations will be abbreviated or omitted when it may make the subject matter of the present invention unnecessarily unclear.

Hereinafter, a wig capable of forming a natural bent hair according to the present invention (hereinafter, simply referred to as a "wig") will be described in detail with reference to the accompanying drawings.

Prior to the description, it may be described that a parting line P/L described below is formed at a central portion of a crown area 320 for clarity of the subject matter of the present invention, but is not limited thereto. It is noted that the parting line P/L may be formed to be biased in the crown area 320, if necessary.

Furthermore, for clarity of the description of the the present invention, it may be described hereinafter that the long hairs knotted in a non-crown area 310 are represented by first long hairs 110 and another long hairs knotted in the crown area 320 are represented by second long hairs 210, but it is noted that in addition to first long hairs 110 and second long hairs 210, the short hairs are hairs for wig using artificial or natural hairs.

Figure 2:
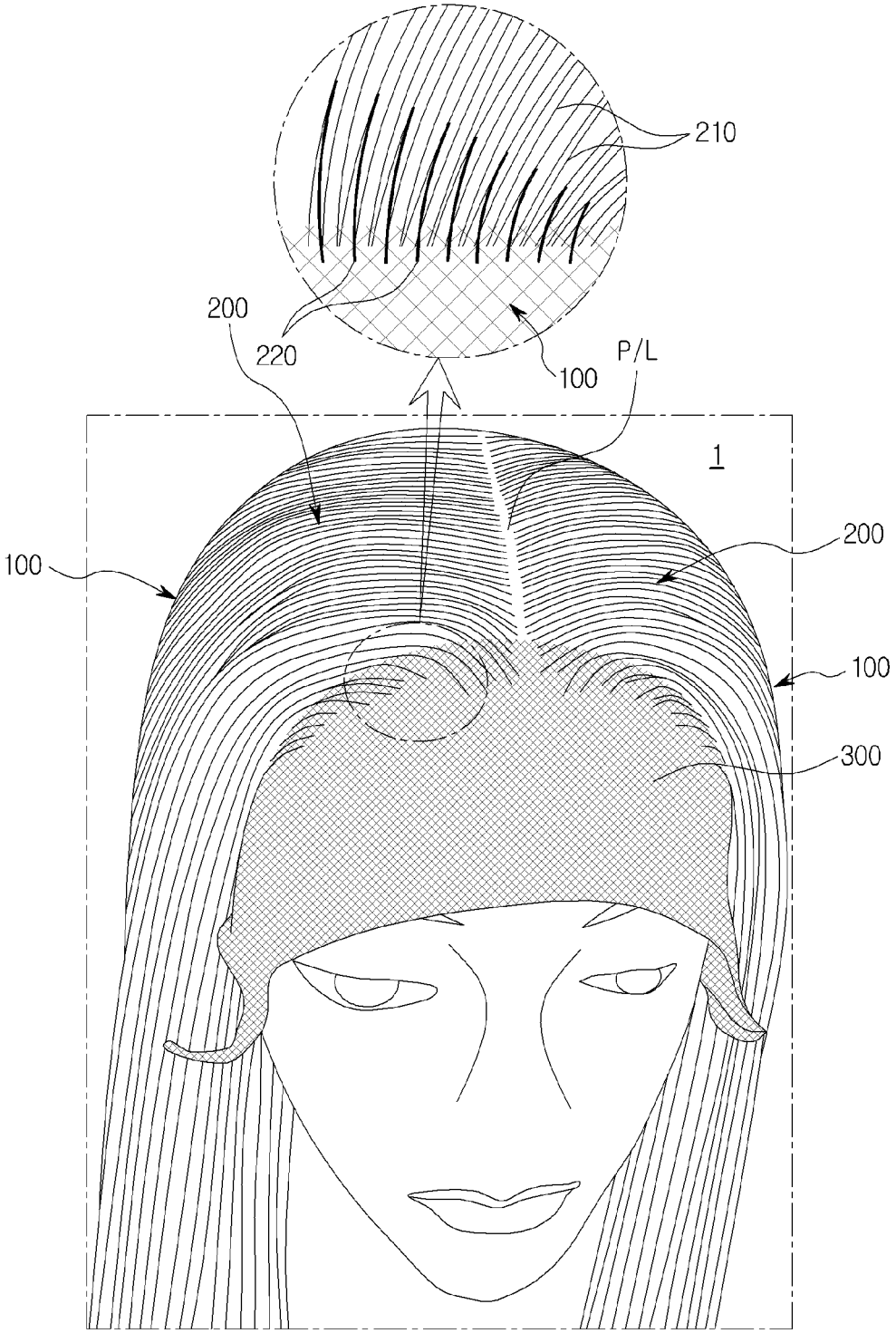
FIG. 2 is a view showing a wig capable of forming a natural bent hair according to the present invention.

First, as shown in FIG. 2, a wig 1 according to the present invention may include a hair portion 100 and a bent hair forming portion 200.

Figure 3:
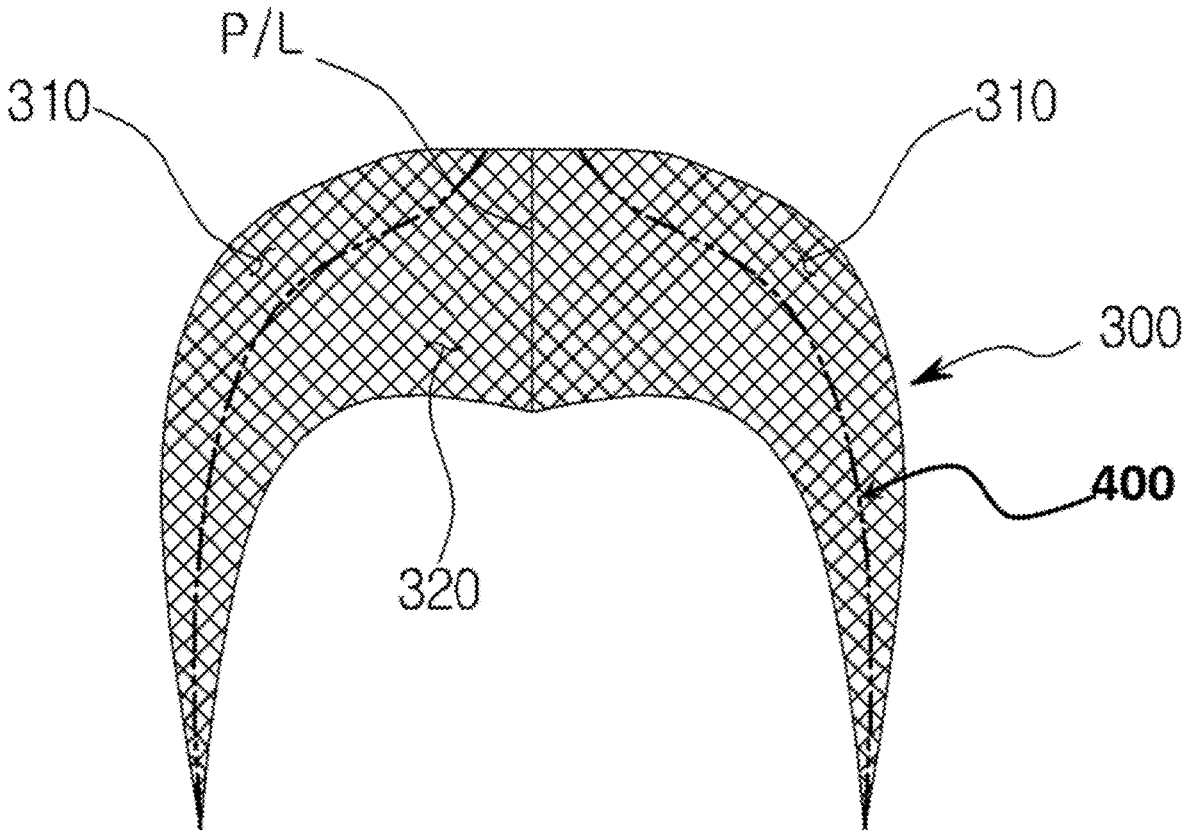
FIG. 3 is a view showing a hair net for a wig capable of forming a natural bent hair according to the present invention.
Figure 4:
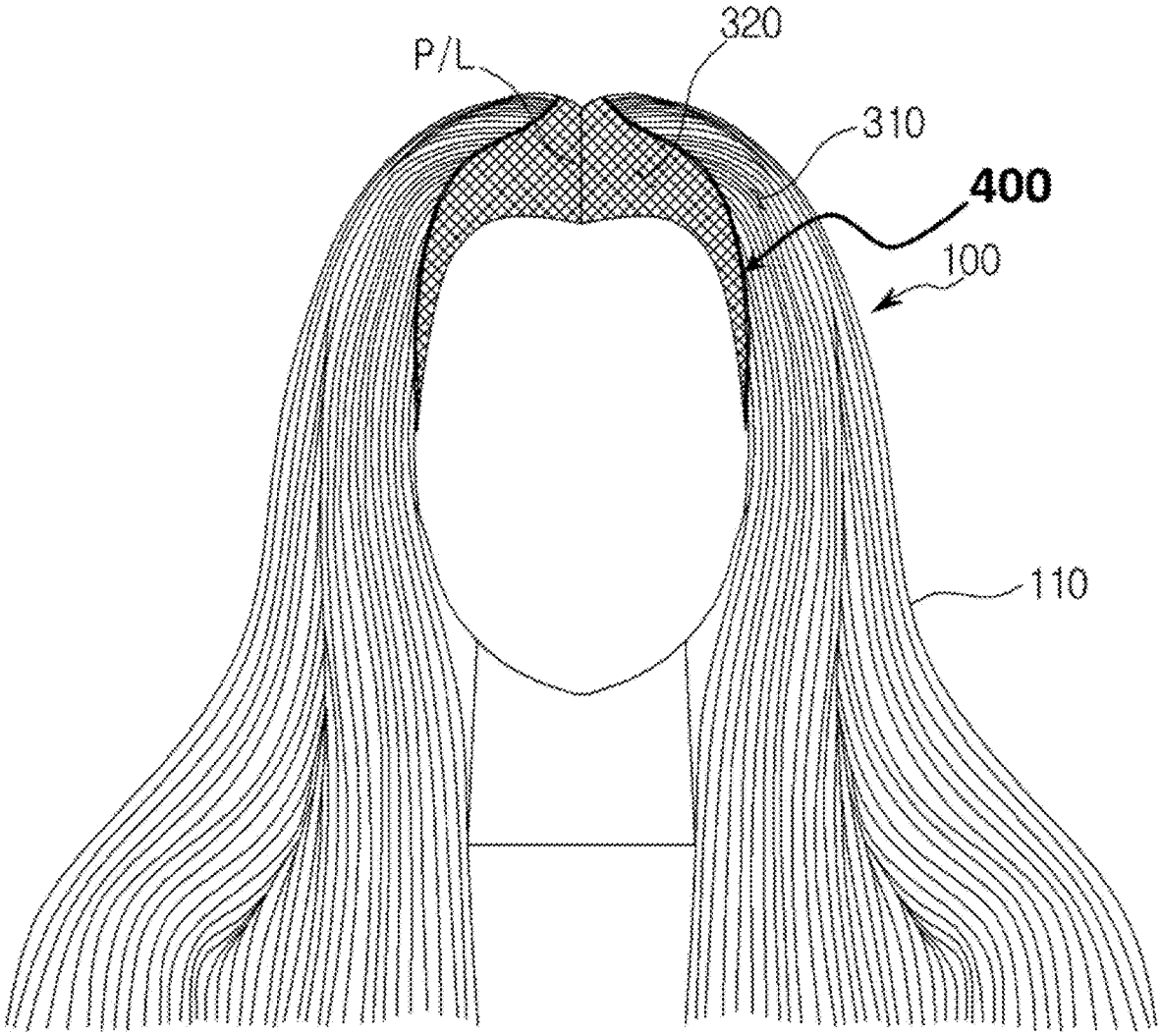
FIG. 4 is a view showing first long hairs which are knotted in a non-crown area of FIG. 3.
Figure 5A:
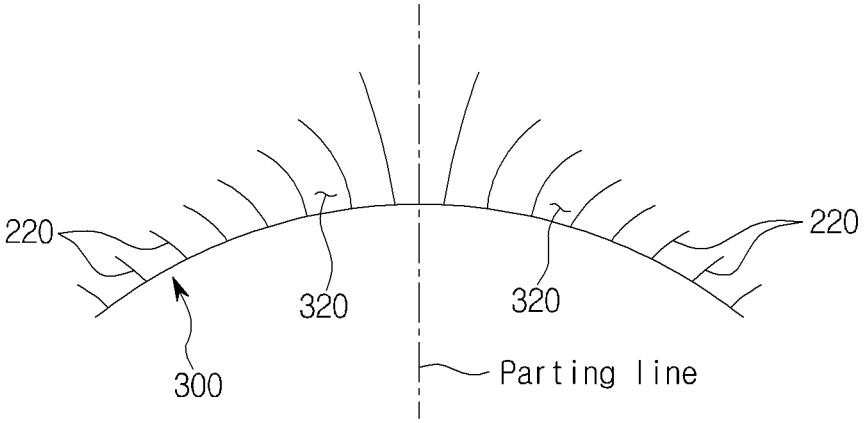
FIGS. 5*a*-5*b* are views showing a state in which short hairs are knotted in a crown area of FIG. 3.
Figure 5B:
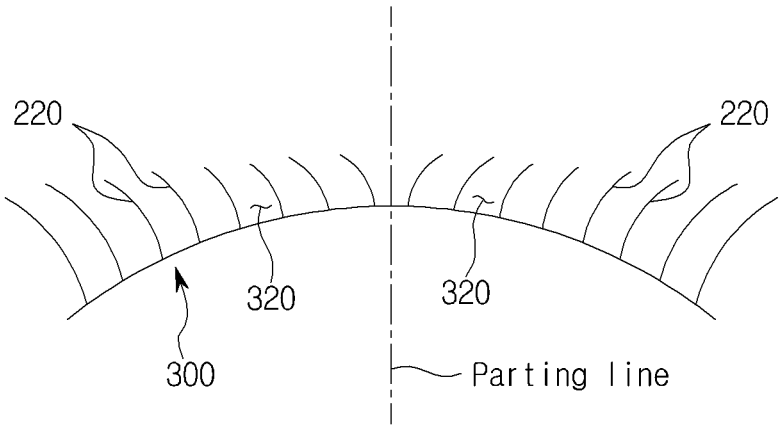
Figure 6A:
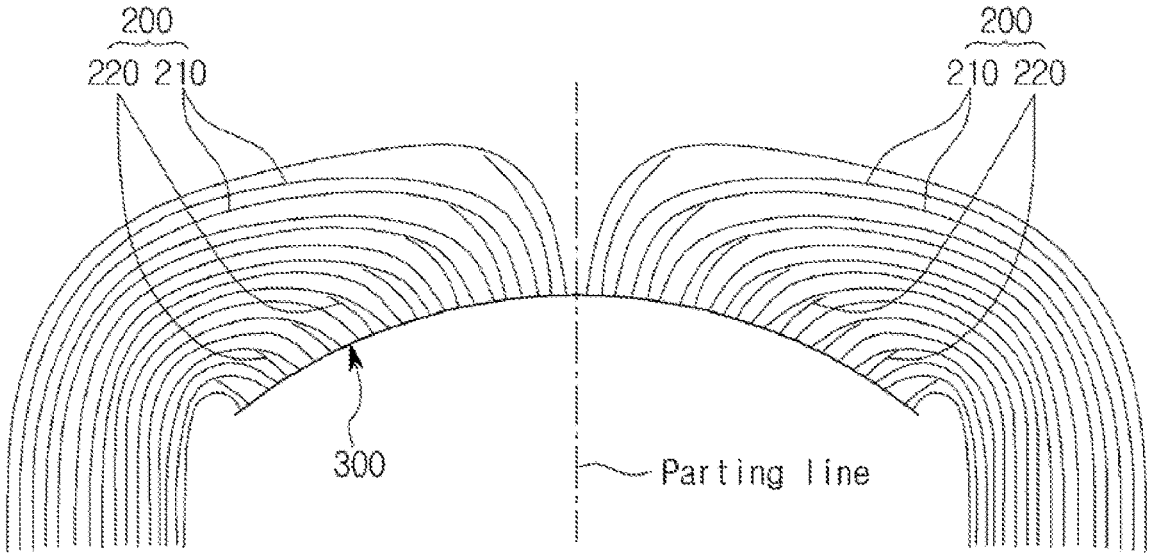
FIGS. 6*a*-6*b* and 7 are views showing a state in which second long hairs are knotted to rest on the short hairs knotted in a crown area of FIG. 4.
Figure 6B:
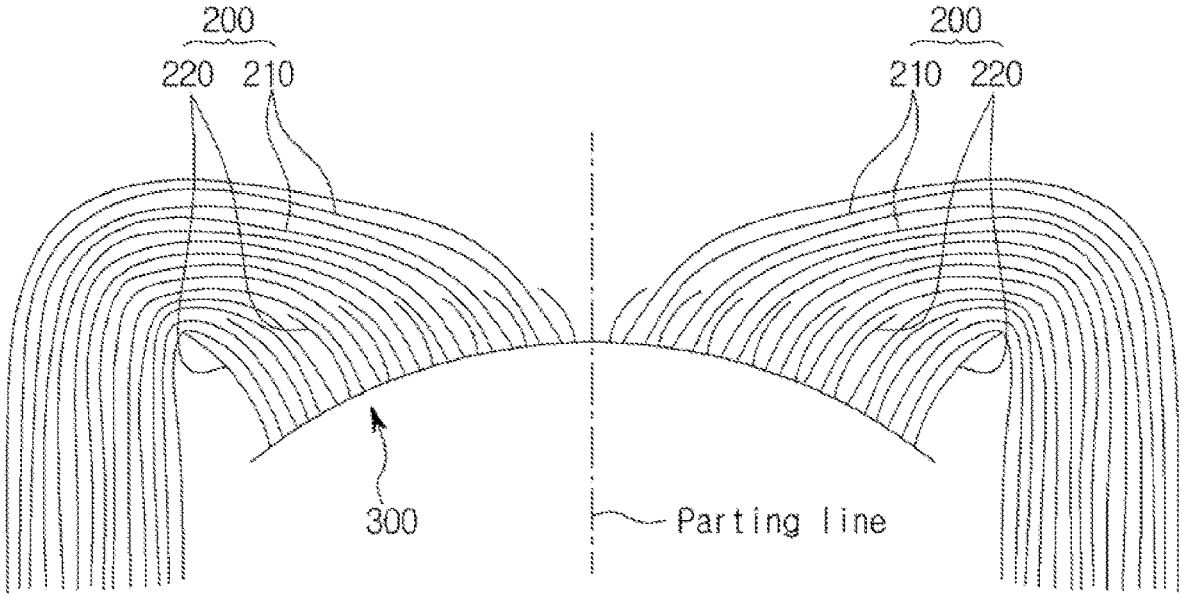
Figure 7:
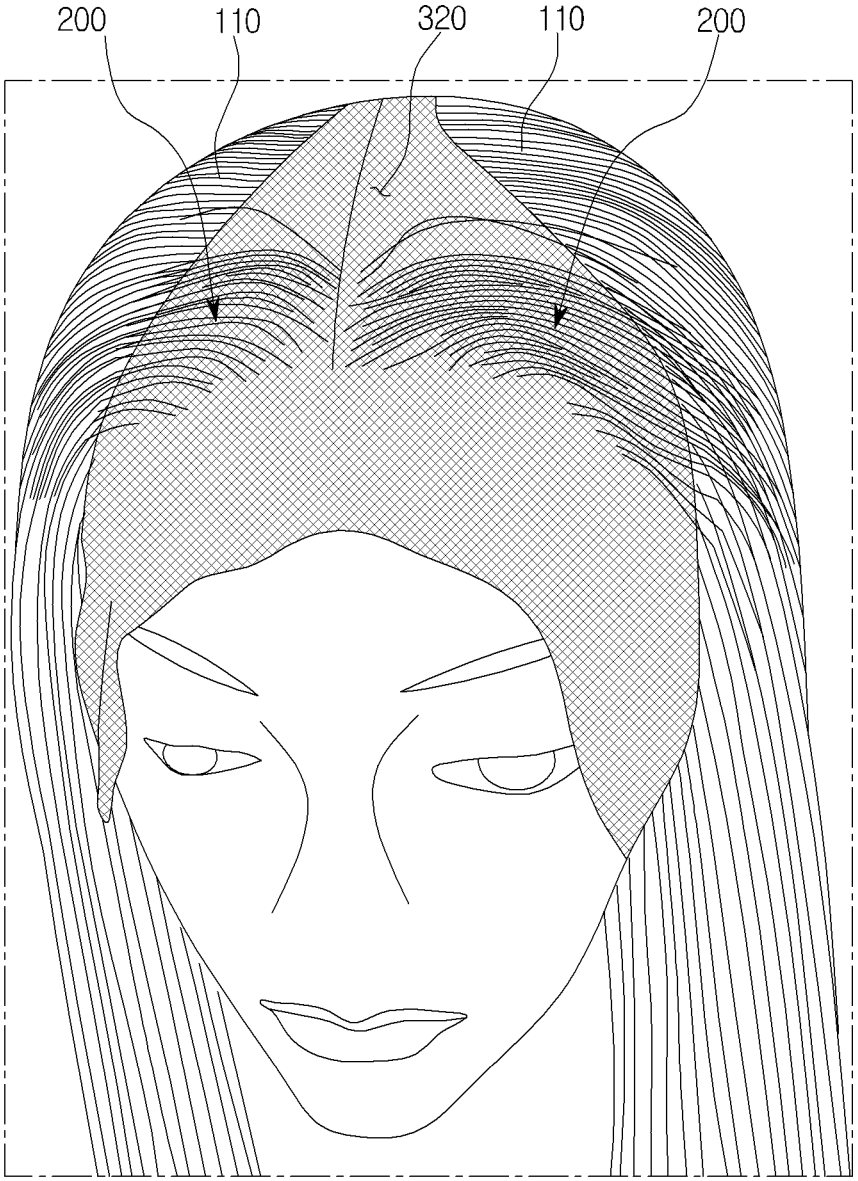

To describe in more detail, the hair portion 100 may be configured to form a hair texture at side and rear hairs of a user as shown in FIGS. 3 and 4.

For example, as shown, the hair portion 100 may be formed by knotting a plurality of first long hairs 110 in one direction in a mesh type of a hair net 300 having a plurality of pores so as to hang down.

The hair portion 100 may be formed in the non-crown area 310 having any area in the hair net 300, in which the non-crown area 310 may refer to an area excluding the crown area 320 where the bent hair forming portion 200 to be described below is knotted.

The hair portion 100 may be formed by being knotted to have a regular or irregular pattern using only the first long hairs 110 having different lengths.

The hair portion 100 may be formed symmetrically to each other based on the parting line P/L.

In this case, although not shown, the non-crown area 310 and the crown area 320, which are arbitrarily formed in the hair net, may be displayed by a worker in a boundary line 400 having a color so that the worker may easily identify the same with the naked eye, thereby knotting the hair composed of at least one of the long hair or the short hair. The crown area 320 has a front edge configured to extend along a hairline of a user adjacent to the temples and forehead, where the front edge has opposing first and second terminal ends. Boundary line 400 extends inwardly from each of the first and second terminal ends of the front edge toward the parting line P/L, in a posterior direction away from the front edge, such that the crown area 320 tapers from the front edge toward a rear side of the hair net 300.

In addition, as shown in FIGS. 4 to 7, the bent hair forming portion 200 may form the entire wig 1 together with the hair portion 100 described above and in particular, may be configured to form a natural bent hair by knotted hairs based on the parting line P/L of the wig 1 and may be implemented by knotting the second long hairs 210 and short hairs 220.

For this purpose, as shown, the bent hair forming portion 200 may be formed in the crown area 320 and preferably, a plurality of short hairs 220 may be knotted to have an irregular pattern with respect to the entire crown area 320, and then the second long hairs 210 may be knotted in the crown area 320.

The crown area 320 may be arbitrarily formed in the hair net 300 so that areas symmetrical to each other may be formed on both sides based on the parting line P/L.

As shown, the short hairs 220 knotted in the crown area 320 may be formed to have a gradual decrease or increase in height so that upper and lower ends thereof may be applied differently from each other in a direction from the parting line P/L to the non-crown area 310. For this purpose, the short hairs 220 may have a gradual decrease in inclination, that is, may be inclined in a corresponding direction.

As one example, when the short hairs are knotted to have an inclination at a right angle, the long hairs may rest on an upper end of the corresponding short hairs to show a remarkable volume, and an inclination of the short hairs knotted toward the non-crown area 310 may hang down toward the hair net 300 to form a natural volume or bent hair.

In other words, a volume of the long hairs resting on the short hairs having an inclination smaller than a right angle may be relatively less than that of the long hairs resting on the short hairs having an inclination equal to a right angle, thereby providing a natural hair style.

Hereinafter, a method for manufacturing a wig capable of forming a natural bent hair according to the present invention (hereinafter, simply referred to as a "method for manufacturing a wig") will be described in detail with reference to the accompanying drawings.

Prior to the description, the manufacturing of a mesh type of hair net 300 having a plurality of pores (holes for discharging sweat) described below will be omitted for clarity of the subject matter of the present invention.

Figure 8:
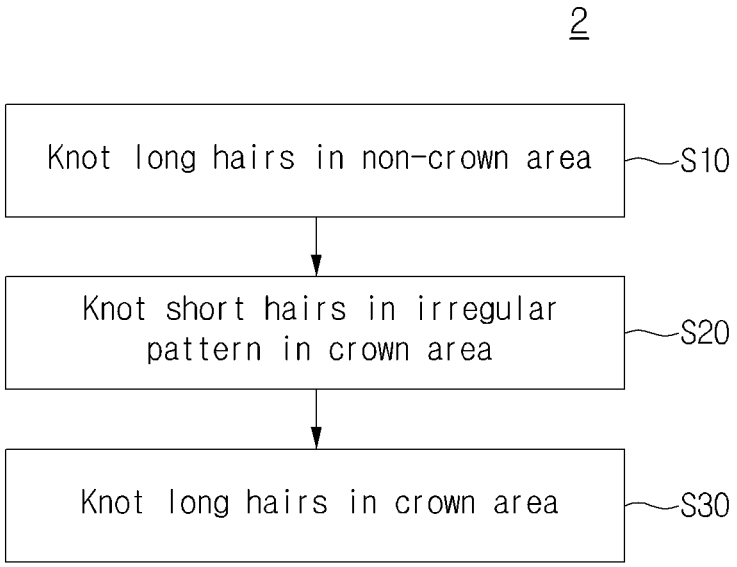
FIG. 8 is a flow chart showing a method for manufacturing a wig capable of forming a natural bent hair according to the present invention.

First, as shown in FIG. 8, a method for manufacturing a wig 2 according to the present invention may largely include 1) shaping a hair portion 100 by knotting a plurality of long hairs to hang down toward a non-crown area 310 of a hair net 300 (S10), 2) knotting short hairs in an irregular pattern in a crown area 320 excluding the non-crown area 310 (S20); and 3) knotting long hairs in the crown area 320 excluding a portion in which short hairs are knotted (S30).

To describe in more detail, in order to manufacture the wig 1, a worker may mount the hair net 300 on a cradle having a head, such as mannequin, etc., and then may perform 1) forming a hair portion 100 by knotting a plurality of first long hairs 110 in an arbitrarily set non-crown area 310.

Here, each of the first long hairs 110 knotted in the non-crown area 310 may be knotted with the hair net 300 or a partial wig, to which the first long hairs 110 are knotted or attached in a longitudinal direction on a wig net band taking on a band shape having a predetermined length, may be knotted with the hair net 300.

When the hair portion 100 of above 1) is finished, 2) sequentially knotting the short hairs 220 and the second long hairs 210 in the crown area 320 may be performed.

For this purpose, the worker may preferentially knot a plurality of short hairs 220 in an irregular pattern throughout the entire crown area 320, and then may knot the second long hairs 210 to form the bent hair forming portion 200.

Here, as shown, the short hairs 220 may be knotted so that a height and an inclination thereof may be lowered in a direction from the parting line P/L to the non-crown area 310, thereby forming a natural bent hair in a front head of the user wearing the wig 1.

In other words, after the short hairs 220 and the second long hairs 210 are knotted in the crown area 320, the user may perform brushing or the like in a direction from the parting line P/L to the non-crown area 310, and an end of the second long hairs 210 may hang down toward the non-crown area 310 so that the second long hairs 210 may rest on an upper end of the short hairs 220 having different heights and inclinations, thereby forming a natural bent hair.

Meanwhile, it may be preferable that an entire area of the crown area 320 is symmetrical to each other based on the parting line P/L so that a width thereof may be gradually narrowed in a direction from a front (forehead of the user) to a rear (back of the user) of the hair net 300, thereby implementing a bent hair of the second long hairs 210 intensively in the front head of the user.

Furthermore, the length and height of the long hairs and short hairs in the present invention are not limited, but it may be preferable to have such a length and a height that a bent hair having a height desired by the user may be formed according to a position of being knotted in the crown area 320.

As described above, differently from the related art, the wig 1 according to the present invention may be so configured that short hairs 220 are knotted in an irregular pattern in the crown area 320 excluding the non-crown area 310 formed by knotting a plurality of first long hairs 110, and then a plurality of second long hairs 210 are knotted in the crown area 320 where the short hairs do not exist, so that the second long hairs 210 may be supported at an upper end of the short hairs 220, thus having an effect of implementing a natural bent hair based on the front head portion and the parting line even through a user's brushing, etc.

As described above, the present invention has been described by particular matters such as specific components, etc., and limited embodiments and drawings, but they are provided only to help a more general understanding of the present invention, and the present invention is not limited to the above embodiments, and those skilled in the art to which the present invention pertains can make various modifications and variations from these descriptions.

Accordingly, the scope of the present invention is not to be limited to the described embodiments, and all those having equal or equivalent modifications to the claims as well as the claims to be described later fall within the scope of the present invention.

DESCRIPTION OF REFERENCE NUMERALS

1: A wig capable of forming a natural bent hair according to the present invention

2: A method for manufacturing a wig capable of forming a natural bent hair according to the present invention

| | |
|---|---|
| 100: | Hair portion |
| 110: | First long hair |
| 200: | Bent hair forming portion |
| 210: | Second long hair |
| 220: | Short hair |
| 300: | Hair net |
| 310: | Non-crown area |
| 320: | Crown area |
| P/L: | Parting line |

What is claimed is:

1. A wig comprising:

a hair net having a crown area and a non-crown area;

the crown area having a front edge configured to extend along a hairline of a user adjacent to the temples and forehead, wherein the front edge has opposing first and second terminal ends and the crown area is symmetrical about a parting line extending through a center thereof;

a boundary line extending between the crown and non-crown areas, wherein the boundary line extends inwardly from each of the first and second terminal ends of the front edge toward the parting line, in a posterior direction away from the front edge, such that the crown area tapers from the front edge toward a rear side of the hair net;

the boundary line having a predetermined color;

the non-crown area extending from the boundary line in a direction away from the crown area;

a first plurality of long hairs knotted to the non-crown area;

a second plurality of long hairs knotted to the crown-area, wherein the second plurality of long hairs hang down toward the non-crown area;

a plurality of short hairs knotted in an irregular pattern to the crown area and excluded from the non-crown area, wherein the plurality of short hairs support the second plurality of long hairs adjacent thereto to add volume in the crown area; and the first and second plurality of long hairs are longer than the plurality of short hairs, wherein a height of the plurality of short hairs gradually decreases in a direction from the parting line toward the non-crown area; and wherein an inclination of the plurality of short hairs gradually decreases in the direction from the parting line toward the non-crown area.

2. A method of manufacturing a wig, the method comprising:

i) providing a hair net having a crown area, a non-crown area and a boundary line between the crown area and non-crown area;

the crown area having a front edge configured to extend along a hairline of a user adjacent to the temples and forehead, wherein the front edge has opposing first and second terminal ends and the crown area is symmetrical about a parting line extending through a center thereof;

the boundary line extending inwardly from each of the first and second terminal ends of the front edge toward the parting line, in a posterior direction away from the front edge, such that the crown area tapers from the front edge toward a rear side of the hair net;

the boundary line having a predetermined color; and the non-crown area extending from the boundary line in a direction away from the crown area;

ii) knotting a first plurality of long hairs to the non-crown area;

iii) knotting a second plurality of long hairs to the crown-area, wherein the second plurality of long hairs hang down toward the non-crown area; and iv) knotting a plurality of short hairs in an irregular pattern to the crown area, wherein the plurality of short hairs support the second plurality of long hairs adjacent thereto to add volume in the crown area, wherein the first and second plurality of long hairs are longer than the plurality of short hairs;

wherein a height of the plurality of short hairs gradually decreases in a direction from the parting line toward the non-crown area; and wherein an inclination of the plurality of short hairs gradually decreases in the direction from the parting line toward the non-crown area.

* * * * *